US008771056B2

(12) United States Patent
Berman et al.

(10) Patent No.: US 8,771,056 B2
(45) Date of Patent: Jul. 8, 2014

(54) SYSTEMS, APPARATUSES AND METHODS FOR AWARDING GAMING PAYOUTS

(76) Inventors: Bradley Berman, Minnetonka, MN (US); Ryan Strand, Hopkins, MN (US); Chad Shapiro, Plymouth, MN (US); Sara Minor, St. Louis Park, MN (US)

( * ) Notice: Subject to any disclaimer, the term of this patent is extended or adjusted under 35 U.S.C. 154(b) by 179 days.

(21) Appl. No.: 12/852,167

(22) Filed: Aug. 6, 2010

(65) Prior Publication Data

US 2011/0034234 A1 Feb. 10, 2011

Related U.S. Application Data

(60) Provisional application No. 61/231,982, filed on Aug. 6, 2009.

(51) Int. Cl.
*A63F 9/24* (2006.01)

(52) U.S. Cl.
USPC ..... 463/21; 463/20; 463/16

(58) Field of Classification Search
CPC ..... G07F 17/3244; G07F 17/3267
USPC ..... 463/16, 20, 30, 21
See application file for complete search history.

(56) References Cited

U.S. PATENT DOCUMENTS 6,089,977 A 7/2000 Bennett
6,251,013 B1 6/2001 Bennett
6,290,600 B1 9/2001 Glasson
6,311,976 B1 11/2001 Yoseloff et al.
6,419,579 B1 7/2002 Bennett
6,439,993 B1 8/2002 O'Halloran
6,517,432 B1 2/2003 Jaffe
6,551,187 B1 4/2003 Jaffe
6,561,900 B1 5/2003 Baerlocher et al.
6,565,433 B1 5/2003 Baerlocher et al.
6,572,472 B1 6/2003 Glavich
6,602,136 B1 8/2003 Baerlocher et al.
6,632,140 B2 10/2003 Berman et al.
6,638,165 B2 10/2003 Uchiyama et al.
6,645,074 B2 11/2003 Thomas et al.
6,672,960 B1 1/2004 B-Jensen
6,676,512 B2 1/2004 Fong et al.
6,780,109 B2 8/2004 Kaminkow
6,802,775 B2 10/2004 Baerlocher et al.
6,805,349 B2 10/2004 Baerlocher et al.
6,896,615 B2 5/2005 Berman
6,918,832 B2 7/2005 Baerlocher et al.
6,960,133 B1 11/2005 Marks et al.
7,104,888 B2 9/2006 Miereau et al.
7,144,322 B2 12/2006 Gomez et al.
7,226,359 B2 6/2007 Bussick et al.
7,396,279 B2 7/2008 Berman et al.
2002/0025847 A1 2/2002 Thomas et al.
2003/0054874 A1 3/2003 Kaminkow
2003/0057645 A1 3/2003 Baerlocher et al.
2003/0060267 A1 3/2003 Glavich et al.

(Continued)

FOREIGN PATENT DOCUMENTS

WO WO9732285 9/1997

*Primary Examiner* — Damon Pierce

(57) ABSTRACT

Methods, apparatuses, and systems for awarding gaming payouts in slot games are provided. Embodiments are directed to initiating a reelspin and moving at least one modifying symbol to a new symbol location. If a predetermined symbol appears in the new symbol location as a result of the reelspin, the predetermined symbol is replaced with the modifying symbol.

16 Claims, 10 Drawing Sheets

(56) References Cited

U.S. PATENT DOCUMENTS

| | | | | |
|---|---|---|---|---|
| 2003/0064778 | A1 | 4/2003 | Berman et al. | |
| 2003/0153382 | A1 | 8/2003 | Vancura | |
| 2003/0190947 | A1 | 10/2003 | Baerlocher et al. | |
| 2003/0190948 | A1 | 10/2003 | Baerlocher et al. | |
| 2003/0220134 | A1 | 11/2003 | Walker et al. | |
| 2004/0048646 | A1* | 3/2004 | Visocnik | 463/16 |
| 2004/0063488 | A1 | 4/2004 | Berman | |
| 2004/0082378 | A1 | 4/2004 | Peterson et al. | |
| 2004/0132527 | A1 | 7/2004 | Berman | |
| 2006/0058097 | A1* | 3/2006 | Berman et al. | 463/20 |
| 2008/0108411 | A1* | 5/2008 | Jensen et al. | 463/20 |

* cited by examiner

SYSTEMS, APPARATUSES AND METHODS FOR AWARDING GAMING PAYOUTS

RELATED APPLICATIONS

This application claims the benefit of provisional patent application No. 61/231,982, filed on Aug. 6, 2009, to which priority is claimed pursuant to 35 U.S.C. §119(e) and which is hereby incorporated herein by reference in its entirety.

FIELD OF THE INVENTION

This invention relates in general to games, and more particularly to methods, apparatuses, and systems for providing game features such as slot game features.

BACKGROUND

It is desirable to provide captivating gaming opportunities for game players to maintain player interest, particularly where there are multiple chances of winning and/or increasing payout awards. In furtherance of the need to attract participants to particular gaming machines, there is a continuing need to further the excitement and anticipation in the participation of gaming activities. The present invention fulfills these and other needs and offers advantages over prior art gaming approaches.

SUMMARY

To overcome limitations in the prior art, and to overcome other limitations that will become apparent upon reading and understanding the present specification, the present invention discloses methods, apparatuses, and systems for awarding gaming payouts, such as providing additional chances for obtaining a winning payout and/or augmenting payout awards in gaming activities.

In accordance with one embodiment, a method is provided that includes providing a predetermined or otherwise particular symbol(s) that may appear in one or more symbol locations having at least one of a plurality of different characteristics in different appearances. The reels or other display segments are spun or otherwise presented. At least one of the different characteristics is randomly selected. It is determined whether the predetermined symbol appears in at least one symbol location as a result of the reelspin, and which of the different characteristics was randomly selected. In response to determining that the predetermined symbol appears in at least one symbol location and that at least one appearance of the predetermined symbol includes the randomly selected characteristic, the one or more predetermined symbols having the selected at least one characteristic is replaced with a modifying symbol. The resulting symbols may be analyzed to identify matching symbol combinations.

In a more particular embodiment, the method may include displaying a characteristic indicator that indicates the randomly selected one or more different characteristics. In one representative example, the characteristic indicator is not displayed in a symbol location, where in another example the characteristic indicator is incorporated into the display of a game name identifier.

In accordance with another embodiment, an apparatus is provided that includes a user interface configured to facilitate player participation in a gaming event, and a display to present a representation of a game play area having a plurality of symbol locations. The apparatus further includes a processor configured to provide a predetermined symbol that may appear in one or more symbol locations having at least one of a plurality of different characteristics in different appearances, initiate a reelspin, randomly select at least one of the plurality of different characteristics, determine whether the predetermined symbol appears in at least one symbol location as a result of the reelspin, determine which of the plurality of different characteristics was randomly selected, replace the one or more predetermined symbols having the selected at least one characteristic with a modifying symbol in response to determining that the predetermined symbol appears in at least one symbol location and that at least one appearance of the predetermined symbol includes the randomly selected characteristic, and analyze resulting symbols to identify matching symbol combinations.

In a more particular embodiment of such an apparatus, the display is configured to display a characteristic indicator that indicates the randomly selected one or more different characteristics. In another embodiment, the characteristic indicator is not displayed in a symbol location.

In accordance with another embodiment, a method is provided that includes presenting symbols, such as by way of a reelspin or otherwise. The method involves moving at least one modifying symbol to a new symbol location, and if a predetermined symbol appears in the new symbol location as a result of the reelspin, replacing the predetermined symbol with the modifying symbol.

In a more particular embodiment of such a method, replacing the predetermined symbol includes expanding the modifying symbol to replace each symbol appearing in a group of symbol locations with the modifying symbol, the group of symbol locations including the new symbol location. In another embodiment, the group of symbol locations is at least one of a symbol location row, a symbol location column, an established symbol location payline, a predetermined order of symbol locations, and a plurality of randomly identified symbol locations.

In another alternative embodiment of such a method, the predetermined symbol may appear having different characteristics in different eligible appearances and each eligible appearance of the predetermined symbol is modified based on the characteristics of that appearance. In one example, where the predetermined symbol has a first characteristic, the predetermined symbol is replaced with the modifying symbol and a mathematical modifying symbol. In another example, where the predetermined symbol has a second characteristic, the predetermined symbol and a random number of additional symbols are replaced with the modifying symbol. In still another example, where the predetermined symbol has a third characteristic, the predetermined symbol, and each symbol appearing in a group of symbol locations that includes the new symbol location, are replaced with the modifying symbol. In a particular embodiment, such a group of symbol locations includes at least one of a symbol location row, a symbol location column, an established symbol location payline, a predetermined order of symbol locations, and a plurality of randomly identified symbol locations.

In another alternative embodiment of such a method, the modifying symbol includes a wild symbol. In other embodiments, there is more than one modifying symbol and each modifying symbol moves to a different new symbol location. In yet another embodiment, moving the at least one modifying symbol to a new symbol location involves displaying the modifying symbol in a foreground while displaying the reelspin in a background. In still another embodiment, such a method further includes providing a plurality of predetermined symbols wherein replacing the predetermined symbol with the modifying symbol comprises replacing the predetermined symbol with the modifying symbol if any of the plurality of the predetermined symbols appear in the new symbol location.

In accordance with another embodiment, an apparatus is provided that includes a user interface configured to facilitate player participation in a gaming event, and a display to present a representation of a game play area having a plurality of symbol locations. A processor is provided and configured to initiate a reelspin, move at least one modifying symbol to a new symbol location, and replace a predetermined symbol, that may appear having different characteristics in different eligible appearances, with the modifying symbol based on the characteristics of an eligible appearance when the predetermined symbol appears in the new symbol location at the conclusion of the reelspin.

In a particular embodiment of such an apparatus, the processor may be further configured to replace the predetermined symbol with the modifying symbol and a mathematical modifying symbol when the predetermined symbol has a first characteristic.

In a particular embodiment of such an apparatus, the processor may be further configured to replace the predetermined symbol and a random number of additional symbols with the modifying symbol when the predetermined symbol has a second characteristic.

In a particular embodiment of such an apparatus, the processor may be further configured to replace the predetermined symbol and each symbol appearing in a group of symbol locations, wherein the group includes the new symbol location, with the modifying symbol when the predetermined symbol has a third characteristic.

In other embodiments of such an apparatus, the modifying symbol may be a wild symbol. In still other embodiments, there are a plurality of modifying symbols, where each modifying symbol moves to a different new symbol location, and each predetermined symbol appearing in the corresponding new symbol locations is replaced based on the characteristics of an eligible appearance.

In accordance with yet another embodiment of such an apparatus, the processor may be further configured to provide a plurality of predetermined symbols wherein replacing the predetermined symbol with the modifying symbol comprises replacing the predetermined symbol with the modifying symbol if any of the plurality of the predetermined symbols appear in the new symbol location.

In accordance with yet another embodiment of such an apparatus, the display may present the symbol locations in a first plane while presenting the at least one modifying symbol in a second plane that is closer to a user.

Still other embodiments involve a computer-readable medium including instructions executable by a processor(s) to perform steps comprising any of the functions identified above and throughout the application.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there are illustrated and described representative examples of methods, apparatuses, and systems in accordance with the invention.

BRIEF DESCRIPTION OF THE DRAWINGS

The description herein refers to embodiments illustrated in the following diagrams.

DETAILED DESCRIPTION

Figure 1:
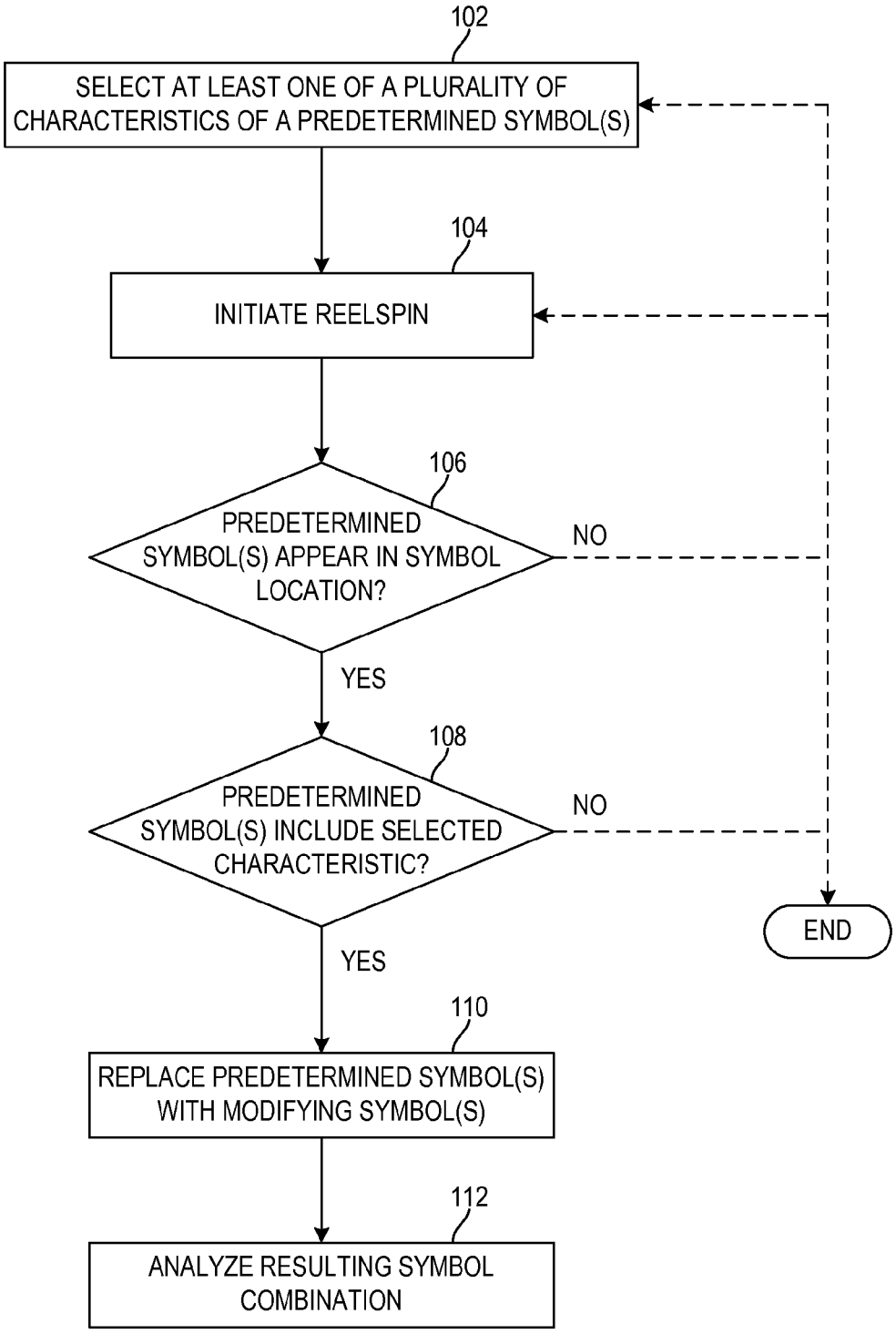
FIG. 1 is a flow diagram illustrating a representative method for providing award-enhancing opportunities in a slot game.

In the following description of various exemplary embodiments, reference is made to the accompanying drawings which form a part hereof and in which are shown by way of illustration various embodiments in which the invention may be practiced. It is to be understood that other embodiments may be utilized, as structural and operational changes may be made without departing from the scope of the present invention.

Many gaming activities, such as slot machine games, involve mechanical or electronic/virtual reel strips or display segments having various symbols associated therewith. A paytable is typically provided, which notifies the player of the payout that will be provided when a consecutive number of particular symbols are presented during play. For example, the paytable may indicate that a payout of six credits will be awarded if three consecutive cherry symbols appear along a pre-established payline; twenty credits will be awarded if three consecutive plum symbols appear along a pre-established payline and so forth. In order for the player to receive a payout, the reels are "spun" (whether mechanically or otherwise randomly selected in an electronic system having a video display), and the symbol combinations presented on established paylines are compared to the possible winning combinations in the paytable. The player receives payouts for any presented symbol combinations on the established paylines that match the payout criteria in the paytable. In such games, the player will receive payouts for those symbol combinations occurring on established paylines but will not receive a payout if no matching symbol combination occurs. Another payout method is generally referred to as a scatter pay, which is awarded when some minimum number of a certain symbol occurs during game play. For example, a rule may indicate that if three start symbols are presented in any of the display segments in response to a reel spin, the player receives a payout. Therefore, with a scatter pay result, there is no succession of symbols presented but rather, a number of a certain symbol in any locations on the viewing area creates a winning combination. Thus, the player would not recognize the winning scatter pay event unless he/she knew that the established number of occurrences of the certain symbol on the viewing area will provide a winning payout or unless the gaming system highlights the winning result. There is no symmetry or other visual alignment that enables the player to immediately recognize a scatter pay as a winning result. The invention described herein is applicable to any type of symbol payout including matching symbol combinations on paylines, scatter pays, etc.

Further, some gaming systems include at least one standard gaming activity and at least one bonus activity. For example, in the context of slot machines, a standard gaming activity includes the normal or native slot game in which the participant places a wager, initiates spinning the slot game reels, and collects payouts upon the occurrence of predetermined winning symbol combinations. A bonus activity is an activity different from the standard gaming activity, which generally only occurs at certain times. In other words, where the standard gaming activity is the gaming activity that is presented to the participant automatically in connection with play of the gaming device, a bonus activity is not automatically presented to the participant. Rather, the bonus activity is generally a special occurrence awarded to the participant for an occurrence resulting from standard gaming play. For example, a bonus event may be awarded to a slot game participant randomly or if a resulting symbol combination occurring during standard slot game activity corresponds to a symbol combination determined in advance to result in a bonus event award. Thus, bonus events are typically used to attract and keep players at a gaming machine and are typically an additional game or machine, or a random selection device, that may be enabled by a bonus qualifying signal from an underlying or primary gaming activity. Often the bonus event has a much higher probability of winning thereby instilling a great interest by players in being awarded bonus events. The invention and embodiments set forth herein are applicable to standard or native gaming activities and, or with, such bonus activities.

Therefore, while embodiments of the present invention may be described below in terms of a standard gaming activity, it should be recognized that the structural and operational features described herein are equally applicable to bonus events where a random or condition-based event occurs that presents the player with a bonus activity incorporating features of the invention. The invention may be used as a standalone game, a primary/base game of a slot game, a bonus game of a slot game, etc. Initiation of gaming features based on the invention may be available in the game with no special conditions, present only if a bonus bet is placed, present only if all lines are covered, etc. Additionally these features may be applied to other existing slot or other games as a feature. Further, the gaming features described herein may be triggered in response to certain gaming event outcomes, at certain times, randomly, on each reelspin, etc.

As discussed above, gaming experiences may be enhanced by increasing a player's chances of winning and/or increasing payout awards. As described below, some embodiments of the invention facilitate such increased excitement to the player through the modification of current symbol presentations to potentially enhance symbol presentations using preferred symbols such as high-value symbols, bonus symbols, wild symbols, etc. As used herein, a high-value symbol may represent one or more of the symbols that provide higher payouts relative to lower value symbols when matching combinations of such symbols occur. A wild symbol typically represents any symbol in the slot game symbol set. Thus, including a wild symbol in a symbol location (also referred to herein as a display segment) on a display grid or other play area increases the chances that a matching symbol combination will appear and result in a payout for the player. As used herein, a display grid represents any area in which symbols of the game are presented, whether in a symmetrical or non-symmetrical fashion.

Generally, the present invention provides methods, apparatuses, and systems for providing payout awards in gaming activities. In accordance with one embodiment, a random event is used to make one or more symbols in respective symbol positions change after a reelspin. A "reelspin" as used herein does not imply a need for spinning physical "reels" (although this may be the case), but rather includes any manner of presenting symbols on a gaming machine, whether based on mechanical or electronic displays. In one embodiment, a random event is used to change one or more symbol positions to preferred symbols (e.g., high-value symbols, wild symbols, etc.) as a result of a reelspin. For example, a random event could include a symbol position(s) displaying a predetermined symbol, displaying a predetermined symbol including a pre-selected characteristic, a superimposed wild symbol moving to a symbol location displaying a predetermined symbol as a result of a reelspin, or the like. The random nature of the event combined with the anticipation of the reelspin result enhance the excitement of the gaming activity.

In one embodiment, the invention provides a gaming activity that combines the random selection of a symbol characteristic with the opportunity for a preferred symbol(s), such as a wild symbol, to replace a symbol having the selected characteristic.

FIG. 1 is a flow diagram illustrating a representative method in accordance with the invention. At least one of a plurality of characteristics of a predetermined symbol is selected in 102. The selection may be made, for example, randomly by the gaming device or an option may be provided for the player to select one or more characteristics via a user input. For example, the gaming device may make the selection by randomly identifying the one or more characteristics. A player may similarly select the one or more characteristics by, for example, using a user interface to initiate a random characteristic selection or to directly select the characteristic (s).

A reelspin is initiated 104. The reelspin generally involves any alteration of the symbols in a game play area or display, such as by spinning mechanical reels or display segments, providing an electronic visual representation of reels/display segments spinning or otherwise changing, or otherwise presenting symbols randomly in a gaming area. For example, a 3×5 grid of display segments may be used, where various symbols of a symbol set can be presented in any of the fifteen display segments. The symbols presented can be symbols otherwise used to obtain winning payouts in a standard slot game, which is based on a paytable of various payouts depending on which symbol is consecutively presented on a pre-established payline. Such symbols are presented randomly in the display segments. It should be noted that "randomly" in this sense does not require or imply pure randomness; e.g., the symbols may be, and often are, weighted in some fashion. Thus, "random" or "randomly" as used herein refers to at least some degree of randomness. As a result of the reelspin, different symbols are displayed in the symbol locations of the grid. Notably there is no limitation on the order of the features 102/104, as the characteristic may be selected before, during or after the reelspin.

As a result of the reelspin 104, it is determined 106 whether a predetermined symbol(s) appears in a symbol location(s) of the play area or "grid." "Predetermined" in this sense does not imply a temporal limitation, but rather that that symbol is known at least by the time the decision 106 is made. Thus, the predetermined symbol or symbols may be determined well in advance and programmed into the game itself, or may be randomly selected at the time of play and is therefore predetermined relative to the decision 106. Again, the predetermined symbol may be predetermined within the game configuration itself, by the gaming device before or during play, by the player prior to starting the game or during a reelspin, etc. There may be one or more predetermined symbols. If the predetermined symbol(s) does not appear in a symbol location, the game or feature may end or return to a previous operational state such as blocks 102 and 104, etc.

If the predetermined symbol(s) does appear in a symbol location(s), it is determined 108 whether the predetermined symbol includes the selected characteristic. Again, if the predetermined symbol(s) does not include the selected characteristic, the game or feature may end or return to a previous operational state such as blocks 102 and 104. However, if the predetermined symbol includes the selected characteristic, the predetermined symbol is replaced 110 with a modifying symbol, such as a wild symbol. In one embodiment, if more than one predetermined symbol having the selected characteristic(s) appears, each of the qualifying predetermined symbols is replaced with a wild symbol.

The modifying symbol(s) may replace the predetermined symbol(s) in any fashion, such as completely replacing the predetermined symbol(s), overlaying the predetermined symbol(s) with the modifying symbol(s), attaching the modifying symbol(s) to the predetermined symbol(s) as sub-symbols, etc. Further, the modifying symbol(s) may, in some embodiments, visually depict moving or floating about the symbol display area prior to ultimately landing on or otherwise becoming associated with the symbol location of the respective predetermined symbol to which it is replacing. In other embodiments, the modifying symbol(s) does not move or float.

Once the qualifying predetermined symbols have been replaced, the resulting symbol combinations may be analyzed 112 for payout determinations. Winning symbol combinations, based on the standard paytable(s) of the game, may have occurred. If so, a payout(s) may be provided in the normal fashion. In accordance with embodiments of the present invention, a different type(s) of payout based on different criteria may be provided.

Figure 2A:
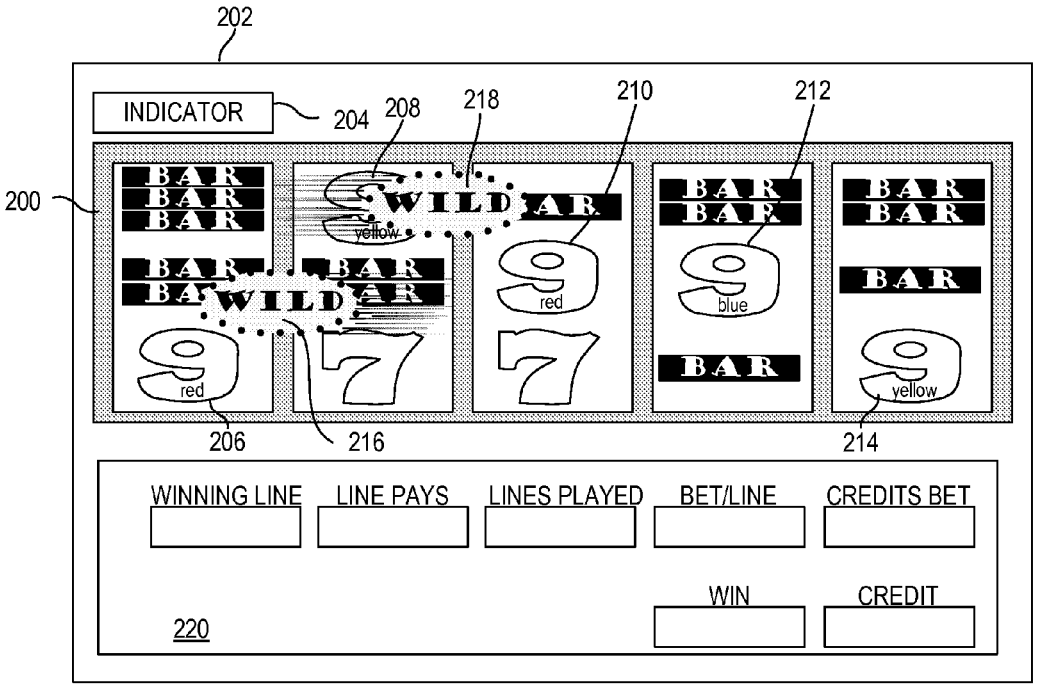
FIG. 2A illustrates a display grid useful for providing a gaming activity having one or more modifying symbols replace a predetermined symbol having a selected characteristic in accordance with embodiments of the present invention.
Figure 2B:
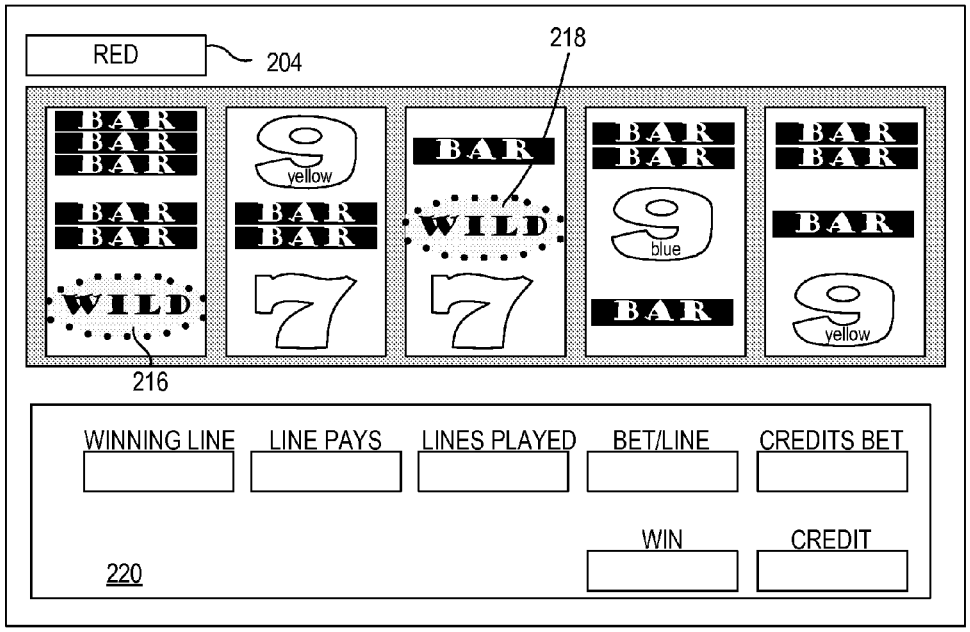
FIG. 2B illustrates a display grid useful for providing a gaming activity having one or more modifying symbols replace a predetermined symbol having a selected characteristic in accordance with embodiments of the present invention.

A representative embodiment of the invention is illustrated in FIGS. 2A and 2B, which depict a sequence of events carried out in connection with a slot machine. FIG. 2A illustrates an example of a slot game grid 200 that may be presented on a slot game display 202. Different slot games may exhibit a variety of different reel characteristics and display formats. For example, some slot games include a conventional three-reel configuration traditionally used in mechanical-reel slot machines. In a three-reel configuration, three reels each having an associated reel strip of symbols rotate vertically as viewed by the participant. The reels stop at random locations, thereby presenting the participant with one, two, three, or more paylines of potentially winning symbol combinations, which may depend on the amount wagered by the participant. More recently, electronic reels and display segments are used in electronic displays, resulting in a variety of different reel formats, including greater quantities of vertically rotating electronic reels, greater numbers of paylines, and paylines that include vertical, diagonal, as well as the traditional horizontal paylines. The present invention may be applicable with any reel configuration; however, the slot game grid 200 is shown as having three rows and five columns.

In the embodiment of FIGS. 2A and 2B, when a characteristic of a predetermined symbol is selected, the selected characteristic may be displayed in a characteristic indicator 204. As previously noted, the characteristic identified in the indicator 204 may be selected by the game itself or may be selected by the player such as by way of a user interface 220. The characteristic indicator may be displayed anywhere, but in one embodiment it is included on the slot game display 202. The characteristic indicator may be displayed in other areas as well, such as on the slot game grid 200, such as with a special symbol(s), sub-symbol, display segment background, etc. The characteristic indicator may be any type of indicator, for example, the indicator could be text directly stating the selected characteristic, a display of the characteristic, or an item including the characteristic. Moreover, the characteristic may be any type of characteristic such as a shape, color, text, and graphic display. One example involves the characteristic of a predetermined symbol being a color of that predetermined symbol where the characteristic indicator is displayed using the same color characteristic. For example, where the plurality of characteristics involve colors, a particular one or more of the colors of the plurality of color characteristics may be presented via the indicator 204. In one embodiment, the name of the game or a logo may be displayed in the selected color characteristic.

Once the characteristic has been selected and symbols are displayed in the slot game grid 200, the displayed symbols are evaluated to determine whether a predetermined symbol(s) appears. For example, a "nine" symbol could be designated as the predetermined symbol. The grid 200 displays five "nine" symbols 206, 208, 210, 212, and 214. In the illustrated embodiment, the predetermined symbols are then evaluated to determine whether any of them also include the selected characteristic. If so, one or more modifying symbols, shown as two moving or "floating" wild symbols 216, 218 may replace the predetermined symbols having the selected characteristic. In one embodiment, the modifying symbols 216, 218 move about the display grid 200 until a characteristic is presented in the indicator 204, which then enables the modifying symbols 216, 218 to move to the predetermined symbols (e.g. "nine" symbols in this embodiment) that also have the selected characteristic. This is described in greater detail in connection with FIG. 2B.

FIG. 2B illustrates the representative slot game grid 200 including a selected characteristic for determining matching symbol combinations. For example, the characteristic indicator 204 shows that the selected characteristic for predetermined symbol "nine" is the color red. Therefore, only the red predetermined symbols, the "nine" symbols 206, 210 in this example, are qualified to be replaced with a modifying symbol. Therefore, FIG. 2B illustrates two "nine" symbols 206, 210 being replaced with a wild modifying symbol 216, 218 in this example. After any of the qualifying predetermined symbols are replaced with the modifying symbol, the resulting symbol combinations are evaluated for winning combinations, taking into account the modifying symbols, which are wild symbols in this example.

Figure 3:
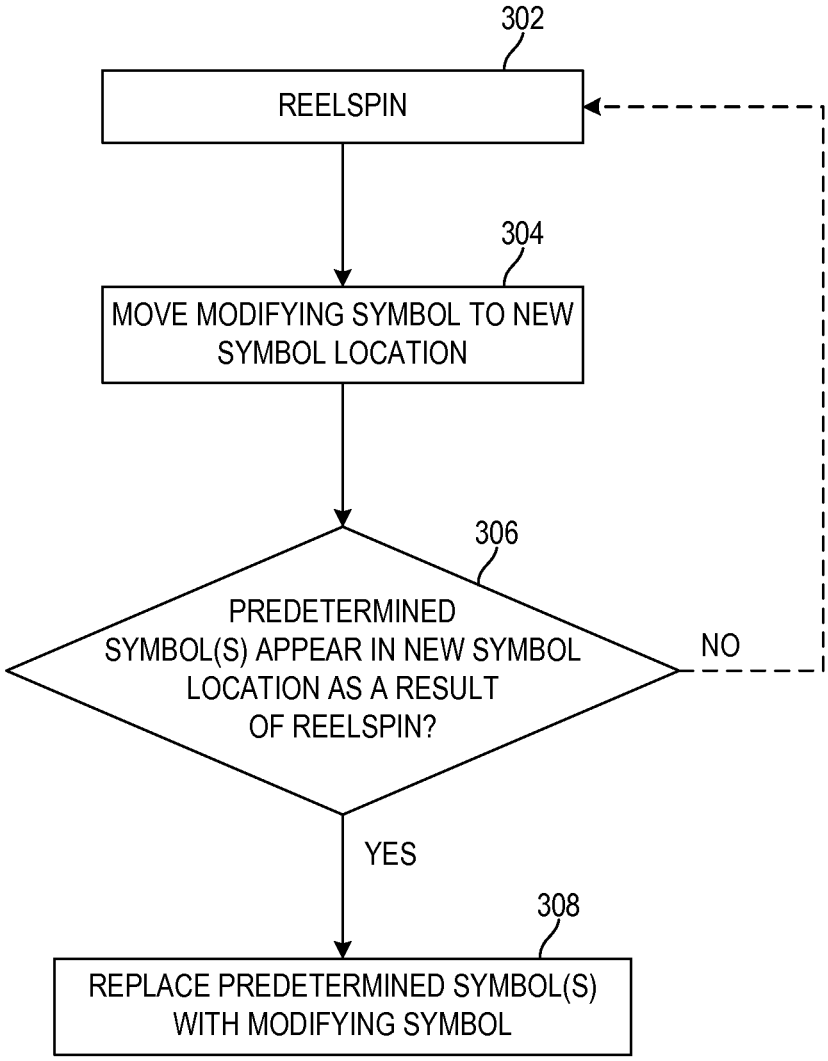
FIG. 3 is a flow diagram illustrating a representative method for providing award-enhancing opportunities in a slot game.

FIG. 3 is a flow diagram of another embodiment of a method in accordance with the invention. A reelspin occurs at block 302, which may be in progress or currently initiated. Before, during, or after the reelspin, one or more modifying symbols are moved 304 to new symbol locations. In the illustrated embodiment, it is determined 306 whether a predetermined symbol(s) appears in a symbol location(s) to which a modifying symbol(s) has moved. If a predetermined symbol(s) does not appear in the symbol location(s) to which the modifying symbols have moved, the game or feature may end or return to a previous operational state such as block 302, etc. However, if a predetermined symbol appears in a symbol location as a result of the reelspin that corresponds to a new symbol location of a modifying symbol, the predetermined symbol is replaced with the modifying symbol 308. Thus, a resulting symbol of the reelspin is replaced if the modifying symbol moved to the same location where a predetermined symbol appeared as a result of the reelspin. As noted above, the modifying symbol(s) may appear at the locations of the one or more predetermined symbols that appear, or may involve other visual attributes such as the modifying symbol (s) moving or floating about the play area and arriving at the location of the predetermined symbol(s).

Figure 4A:
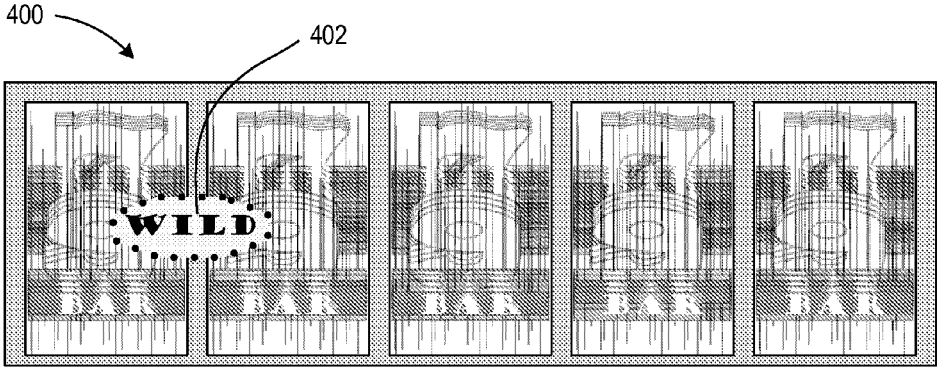
FIG. 4A illustrates a display grid useful for providing a gaming activity having one or more modifying symbols move to a new symbol location in accordance with embodiments of the present invention.
Figure 4B:
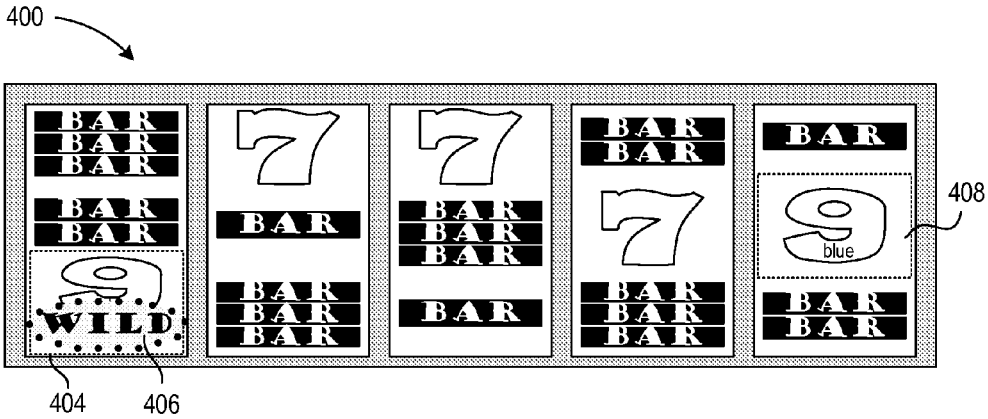
FIG. 4B illustrates a display grid useful for providing a gaming activity having one or more modifying symbols replace a predetermined symbol in accordance with embodiments of the present invention.
Figure 4C:
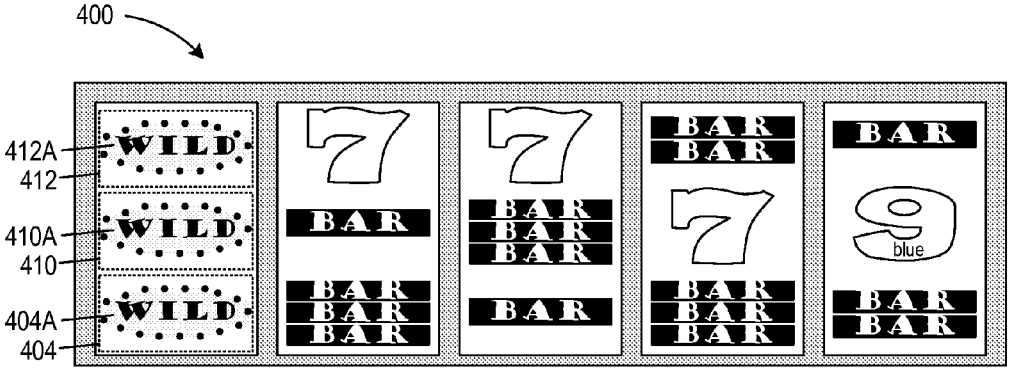
FIG. 4C illustrates a display grid useful for providing a gaming activity having one or more modifying symbols expand in accordance with embodiments of the present invention.

An example of a method such as described in connection with FIG. 3 is illustrated in FIGS. 4A, 4B, and 4C, which depict a sequence of events carried out in connection with a slot machine. FIG. 4A illustrates a reelspin of a slot game grid 400. During the reelspin a wild symbol(s) 402 moves around, and in some embodiment visually over, the slot game grid 400. While the movement of the wild symbol may be depicted during the reelspin, the wild symbol could alternatively move after the reelspin is complete or before the reelspin is initiated. In one embodiment the wild symbol is also depicted in the foreground with the reelspin in the background. This visual effect may also be accomplished by displaying the reelspin in a first plane and the wild symbol in a second plane closer to a user such as is effected using multi-layer displays in Multi-Layer Display (MLD) technology. The result is the appearance of the wild symbol "floating" over the slot game grid 400.

In FIG. 4B, the reelspin has concluded and the wild symbol has stopped moving and "landed" in a new symbol location 404. It is determined whether a predetermined symbol has appeared in symbol location 404 as a result of the reelspin. For this example, the "nine" symbol is the predetermined symbol. Since a "nine" symbol has appeared at symbol location 404 and the wild symbol has moved to the same symbol location, the "nine" symbol is replaced with the wild symbol 406. Notably, symbol location 408 remains unchanged even though a predetermined "nine" symbol appeared because no modifying symbol also moved to symbol location 408.

FIG. 4C illustrates a further embodiment where additional symbols are replaced with the modifying symbol. For example, if a predetermined symbol appears in the same symbol location where a modifying symbol has moved to, instead of just replacing the predetermined symbol, a group of symbols including the predetermined symbol is replaced. As shown, not only is the predetermined ("nine") symbol of symbol location 404 replaced with a wild symbol 404A, the additional symbol locations 410, 412 in the column of symbol location 404 are filled with wild symbols 410A, 412A replacing the previously appearing symbols. The group of symbol locations affected by the wild symbol may be any type of group including a row(s), a column(s), an established payline (s), a predetermined order, a random grouping, etc.

It should also be noted that other actions than replacing symbols may be used in other embodiments, such as triggering a bonus event, providing free spins or initiating a free spin bonus, etc. Thus, in some embodiments, when a modifying symbol such as the floating wild 402 intersects a special or predetermined symbol (e.g., "nine" symbol), other actions may be provided instead or in lieu of modifying the predetermined symbol.

Figure 5:
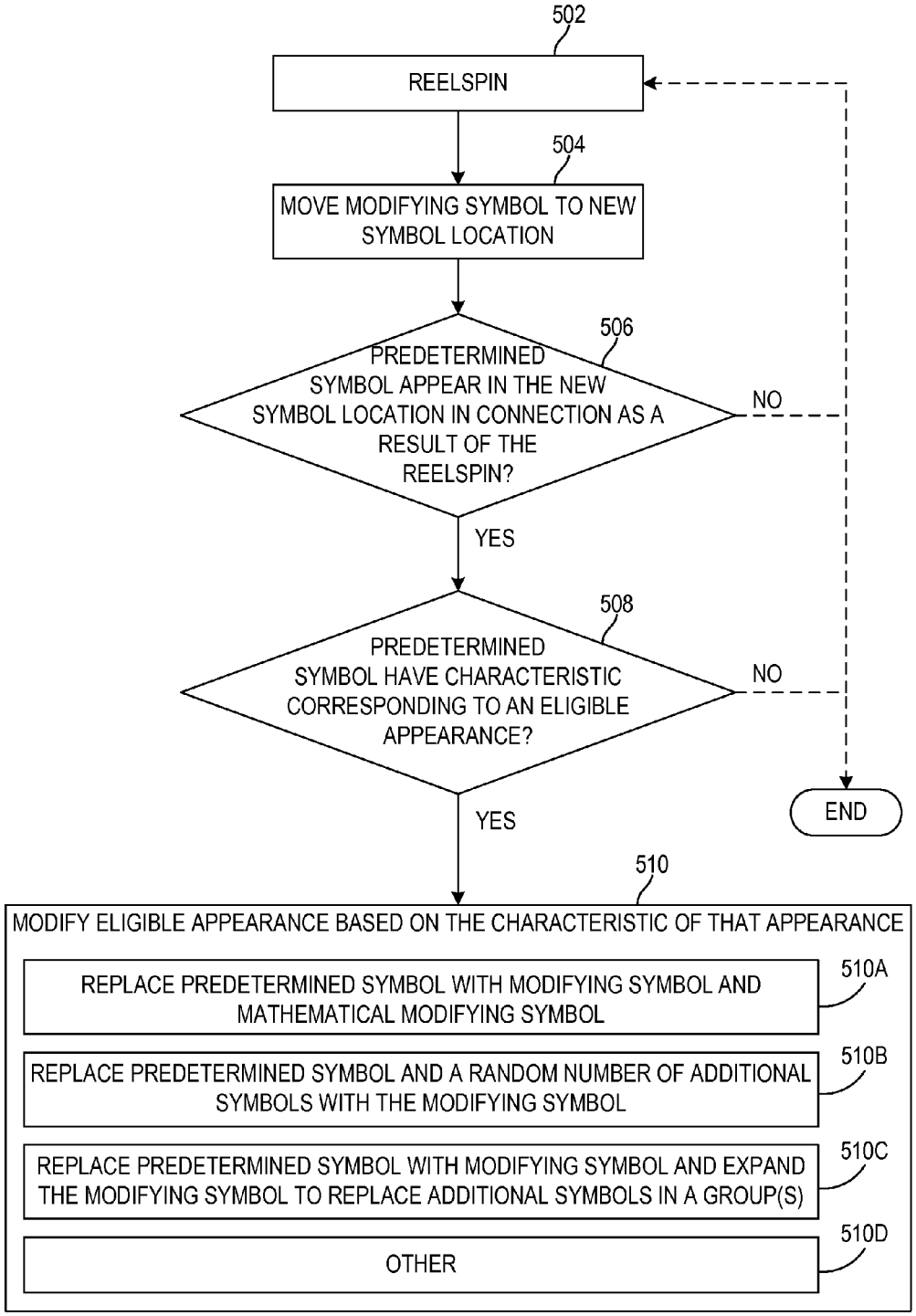
FIG. 5 is a flow diagram illustrating a representative method for providing award-enhancing opportunities in a slot game.

FIG. 5 is a flow diagram of another embodiment of a method in accordance with the present invention. The reels or display segments are spun or otherwise presented as shown at block 502. The reelspin may be in progress or initiated. In one embodiment, during the reelspin or at the conclusion of the reelspin one or more modifying symbols are moved to new symbol locations 504. It is determined 506 whether a predetermined symbol appears in a symbol location to which a modifying symbol has moved. If a predetermined symbol(s) does not appear in the symbol location(s) to which the modifying symbols have moved, the game or feature may end or return to a previous operational state such as block 502, etc.

However, if a predetermined symbol appears in a symbol location as a result of the reelspin that corresponds to a new symbol location of a modifying symbol, it is determined 508 whether the predetermined symbol includes a characteristic corresponding to an eligible appearance. An eligible appearance refers to an appearance of a predetermined symbol that includes a predetermined characteristic where the predetermined characteristic is associated with a type of modification of the predetermined symbol. If the predetermined symbol(s) does not include a characteristic of an eligible appearance, the game or feature may end or return to a previous operational state such as blocks 502, etc. However, if the predetermined symbol includes a characteristic of an eligible appearance, the eligible appearance is modified 510 based on the characteristic of that appearance. Representative modifications of the eligible appearance may include replacing the predetermined symbol with a modifying symbol and a mathematical modifying symbol 510A, replacing the predetermined symbol and a random number of additional symbols with the modifying symbol 510B, replacing the predetermined symbol with the modifying symbol and expanding the modifying symbol to replace additional symbols in a group 510C, and other modifications of the replaced predetermined symbol 510D.

In one particular embodiment of such a method, a dynamic mystery wild symbol appears randomly on the reels after every spin. If the mystery wild appears over any of the predetermined symbols (e.g. "nine" symbols), a bonus is initiated depending on the characteristic (e.g. color), associated with the nine symbol. In a more particular embodiment, a mystery wild symbol that lands on a RED 9 initiates a bonus in which wild symbols are randomly populated among the reels. A mystery wild symbol that lands on a YELLOW 9 initiates a bonus in which the wild symbol gets a multiplier (e.g. 9× multiplier) for any line that intersects it. A mystery wild symbol that lands on a BLUE 9 initiates a bonus in which the wild symbol expands into a stacked wild for that column.

Figure 6A:
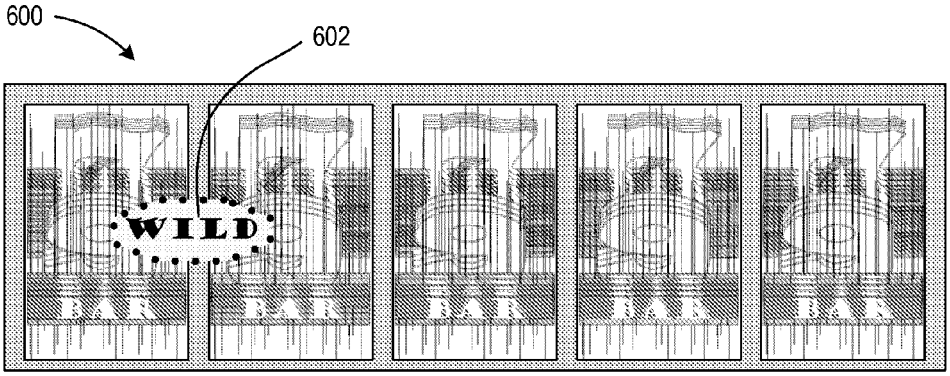
FIG. 6A illustrates a display grid useful for providing a gaming activity having one or more modifying symbols move to a new symbol location in accordance with embodiments of the present invention.

FIGS. 6A-6G illustrate these and other embodiments, which depict alternative sequences of events carried out in connection with a slot machine. FIG. 6A illustrates a reelspin of a slot game grid 600. In connection with the reelspin, a wild symbol(s) 602 moves about the slot game grid 600 in this embodiment. While the movement of the wild symbol is depicted during the reelspin, the wild symbol could move after the reelspin is complete or before the reelspin is initiated. In this embodiment, the wild symbol is depicted in the foreground with the reels in the background. This visual effect may also be accomplished by displaying the reels in a first plane and the wild symbol in a second plane closer to a user such as is effected using MLD technology. The result is the appearance of the wild symbol "floating" over the slot game grid 600.

Figure 6B:
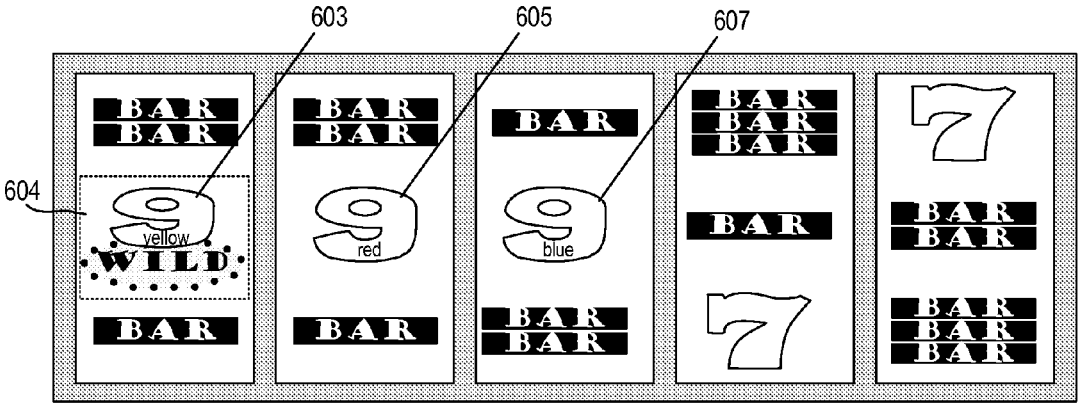
FIG. 6B illustrates a display grid useful for providing a gaming activity having one or more modifying symbols replace a predetermined symbol in accordance with embodiments of the present invention.

In the state shown in FIG. 6B, the reelspin has concluded, and the wild symbol has stopped moving and "landed" in a new symbol location 604. It is determined whether a predetermined symbol has appeared in symbol location 604 as a result of the reelspin, which is the symbol location in which the wild symbol landed. In this example, the "nine" symbol represents the predetermined symbol. Since a "nine" symbol 603 has appeared at symbol location 604 and the wild symbol has moved to the same symbol location 604, it is determined whether the "nine" symbol (which could be any of symbols 603, 605, 607) includes a characteristic of an eligible appearance. For this example, the characteristic is the color of the symbol, where a yellow "nine" symbol 603 corresponds to modifying the replacement wild symbol with a mathematical modifying symbol such as a multiplier. Since the "nine" symbol 603 at location 604 is yellow, the symbol at symbol location 604 represents an eligible appearance of that predetermined symbol.

In the illustrated embodiment, other instantiations of the predetermined symbol that do not include the yellow characteristic (e.g. a blue "nine" 607) could still be eligible appearances, but may not result in triggering its associated feature. For example, other instantiations of the "nine" symbol 605, 607 that do not include the yellow characteristic may be eligible appearances due to their respective characteristics. An example is that a yellow characteristic on a "nine" symbol (or other predetermined symbol) may be configured to provide a first action such as modifying the "nine" to a wild symbol and applying a multiplier, where a blue characteristic on a "nine" (or other predetermined) symbol may be configured to provide a second action such as providing an expanding wild. Thus, while both the yellow and blue characteristics, when occurring with the predetermined symbol, may be eligible appearances as they are associated with characteristics that might perform an action, they may not actually perform that respective action because the modifying symbol did not land or otherwise present itself on its symbol location. Thus, in the example of FIG. 6B, while a RED-9 605 and a BLUE-9 607 may be eligible appearances because features are capable of being triggered when the modifying symbol 602 lands on them, their respective features are not triggered in the illustrated embodiment because the modifying symbol 602 landed on (or otherwise presented itself at) location 604 which is associated with a yellow nine symbol 603 that triggers its own feature, as described in greater detail in connection with FIG. 6C.

Figure 6C:
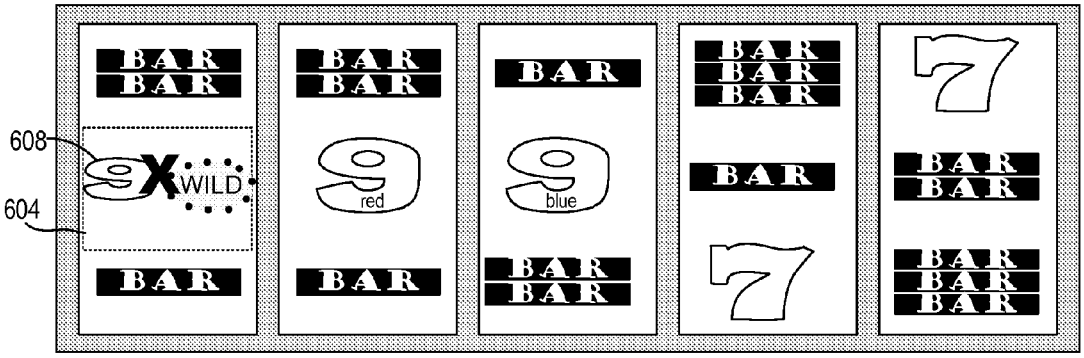
FIG. 6C illustrates a display grid useful for providing a gaming activity having one or more modifying symbols be modified based on the predetermined symbol that was replaced in accordance with embodiments of the present invention.

In response to determining that the predetermined symbol in location 604 is an eligible appearance, FIG. 6C illustrates the modification of the eligible appearance. To modify the eligible appearance, the yellow "nine" symbol is, in the illustrated embodiment, replaced with both a wild symbol and a mathematical modifying symbol. For example, in symbol location 604, the new symbol 608 displayed is a wild symbol with a multiplier and, more specifically, new symbol 608 incorporates the original "nine" symbol by modifying the predetermined "nine" symbol to multiply the wild symbol nine times (9× wild). While a multiplying symbol is shown in this example, any mathematical modifier may be used to modify the wild symbol.

Figure 6D:
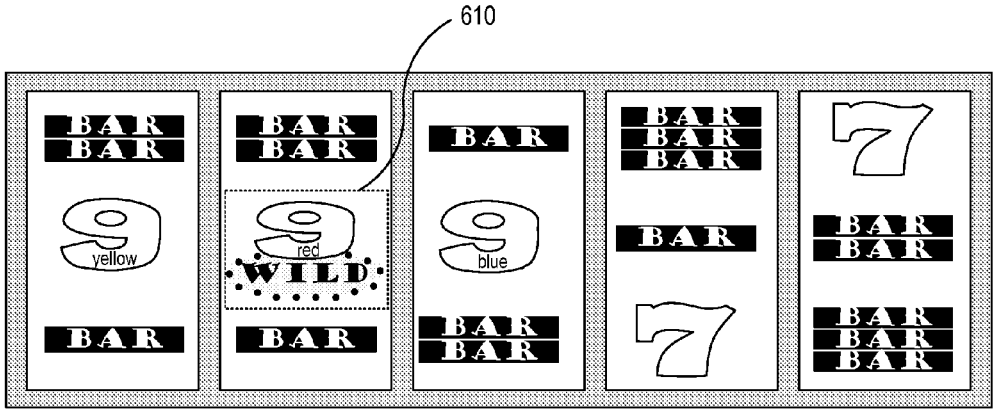
FIG. 6D illustrates a display grid useful for providing a gaming activity having one or more modifying symbols replace a predetermined symbol in accordance with embodiments of the present invention.
Figure 6E:
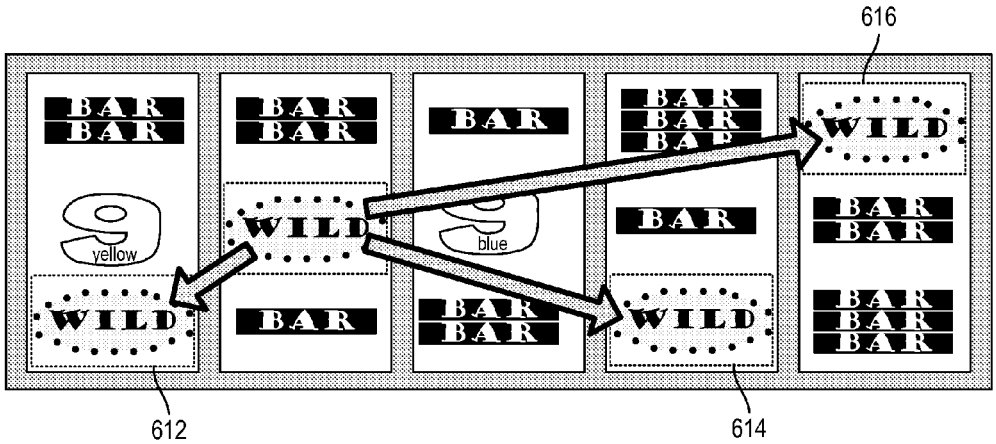
FIG. 6E illustrates a display grid useful for providing a gaming activity having one or more modifying symbols be modified based on the predetermined symbol that was replaced in accordance with embodiments of the present invention.

In the embodiments described in FIGS. 6A-6G, the wild (or other preferred) symbol 602 will cause different outcomes depending on whether the particular appearance for the predetermined symbol corresponds to a modifying event. One such example was described in connection with FIGS. 6B and 6C, where the eligible appearance of the "nine" symbol was a yellow nine symbol, resulting in a wild symbol that also provides a multiplier. FIGS. 6D and 6E illustrate another exemplary eligible appearance, which is a different color associated with the same predetermined symbol. Referring now to FIG. 6D, the reels have been spun, and the wild symbol landed in a new symbol location 610. It is determined whether the predetermined symbol has appeared in symbol location 610 as a result of the reelspin. In this embodiment, the "nine" symbol again represents the predetermined symbol. Since a "nine" symbol has appeared at symbol location 610 and the wild symbol has moved to the same symbol location, it is determined whether the "nine" symbol includes a characteristic of an eligible appearance to obtain the benefit of the feature. In this example, the characteristic is again the color associated with the predetermined symbol, and the eligible appearance of that predetermined symbol is the color red. In this embodiment, where the wild symbol lands on the predetermined symbol having an eligible appearance of red, the symbol is replaced by a wild symbol, and a random or fixed number of other symbols at random or fixed locations will also be replaced with the wild symbol.

FIG. 6E illustrates such a modification of symbols. More particularly, in response to determining that the predetermined symbol in location 610 is an eligible appearance, the predetermined symbol with the eligible appearance of red at location 610 is replaced with a wild symbol. In addition, this embodiment also involves replacing a random number of other symbols with wild symbols. In this example of FIG. 6E, the additional modifications affect symbol locations 612, 614, and 616, where the symbols therein are replaced with wild symbols. Since the additional symbol locations to be modified are randomly selected, they include a random number of symbol locations as well as random locations.

Figure 6F:
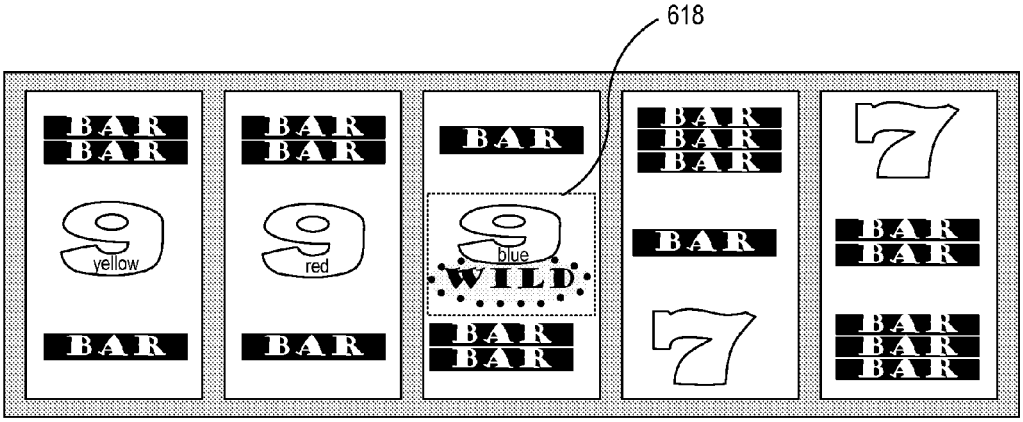
FIG. 6F illustrates a display grid useful for providing a gaming activity having one or more modifying symbols replace a predetermined symbol in accordance with embodiments of the present invention.
Figure 6G:
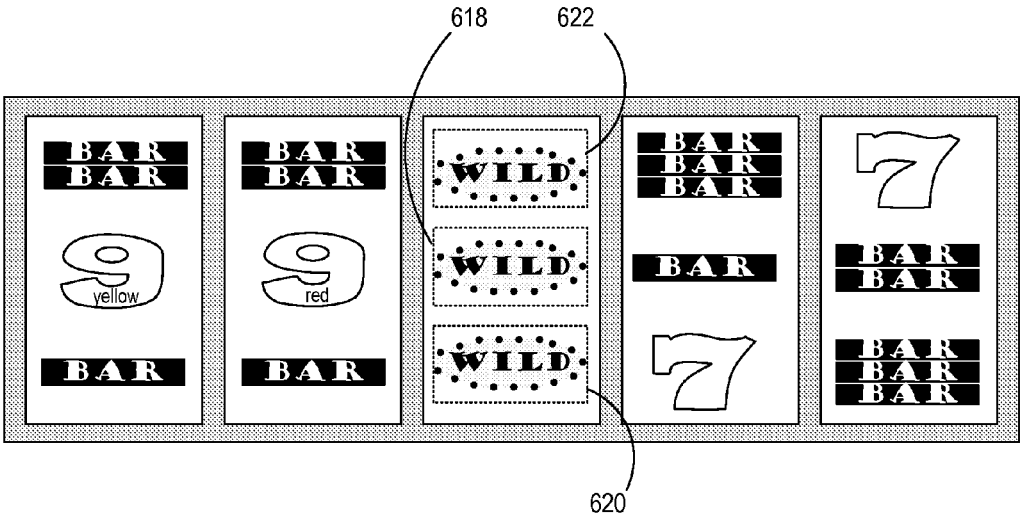
FIG. 6G illustrates a display grid useful for providing a gaming activity having one or more modifying symbols be modified based on the predetermined symbol that was replaced in accordance with embodiments of the present invention.

FIGS. 6F and 6G illustrate yet another embodiment where a different action is taken based on which eligible appearance is affected by a modifying symbol. As shown in FIG. 6F, the symbols have been presented, and the wild symbol has stopped moving and landed in a new symbol location 618. It is determined whether a predetermined symbol has appeared in symbol location 618 where the wild symbol landed. In this example, the "nine" symbol represents the predetermined symbol. Since a "nine" symbol has appeared at symbol location 618 and the wild symbol has moved to the same symbol location, it is determined whether the "nine" symbol includes a characteristic of an eligible appearance. For this example, the characteristic is the color of the symbol where a blue "nine" symbol corresponds to not only replacing the predetermined symbol in location 618 but also replacing each symbol appearing in a group of symbol locations, where the group of symbol locations includes symbol location 618, with the wild symbol. Since the "nine" symbol is blue and a blue "nine" symbol corresponds to a predefined modification, the predetermined symbol in symbol location 618 is an eligible appearance. It should be recognized that the wild expansion could affect symbol groups other than a column/reel, such as a row, payline or partial payline, geometric shape of locations, etc.

In response to determining that the predetermined symbol (e.g. "nine" symbol) in location 618 is an eligible appearance (e.g. one of a plurality of predetermined colors), the eligible appearance of that predetermined symbol having the corresponding characteristic (e.g. color blue) results in a symbol modification. To modify the eligible appearance, the blue "nine" symbol is replaced with a wild symbol. In addition, the rest of the symbols 620, 622 in the same column as symbol location 618 are replaced with wild symbols. The group of symbols to be modified with the eligible blue "nine" symbol may be any type of group including a row, a column, an established payline, a predetermined order, a random grouping, etc.

Whether a predetermined symbol is an eligible appearance of that predetermined symbol depends on which characteristics of that predetermined symbol are associated with triggering a respective feature. Thus, not all situations where a predetermined symbol appears in the new symbol location of a modifying symbol would be an eligible appearance. Using the above example, assume that the characteristics of yellow, red, and blue associated with the predetermined symbol of "nine" will provide some benefitting feature, albeit the features may differ as in the example of FIGS. 6B-6G. In any event, these yellow, red, and blue characteristics are eligible appearances of the predetermined symbol since they are eligible for achieving a respective one of the features. On the other hand, if the characteristic of "green" is not associated with any benefitting feature, then a green "nine" symbol would not be an eligible appearance of the predetermined symbol. In other words, if a green "nine" symbol were to appear, the green "nine" symbol would not be an eligible appearance since the color green does not correspond to a predefined action to be taken if the modifying symbol lands on it. The characteristics corresponding to eligible appearances may be selected by the gaming device or by the user in advance, during, or even after the reelspin. Also, the characteristics corresponding to eligible appearances may change with each reelspin, a dynamic number of reelspins, in response to a winning symbol combination, remain static, etc.

In one embodiment, the randomly presented wild symbols may also intersect other ones of the predetermined symbols that have eligible appearances. For example, the modifying symbols could randomly move to the depicted locations 612, 614 and/or 616 which may themselves include an eligible appearance of the predetermined symbol, just as the location 610 originally did. In such cases, the newly presented modifying symbols (e.g., wild symbols in the embodiment of FIG. 6E) landing on such predetermined symbols with eligible appearances at these locations may trigger the respective actions. As an example, assume that another "nine" symbol with a red characteristic was at location 616 prior to the random placement of the wild at that location. In such case, one embodiment would trigger yet another random placement of wild symbols, analogously to the action taken when the first wild symbol landed on the red nine symbol at location 610. In such an embodiment, if location 616 had a yellow nine symbol in it prior to the random placement of the wild at that location, it could trigger that action, such as further providing a multiplier value (e.g., 9× wild).

It should also be noted that other actions than replacing symbols may be used in other embodiments, such as triggering a bonus event, providing free spins or initiating a free spin bonus, back bonus, etc. Thus, in some embodiments, when a modifying symbol such as the floating wild 602 intersects a special or predetermined symbol (e.g., "nine" symbol), other actions may be provided instead or in lieu of modifying the predetermined symbol.

Figure 7:
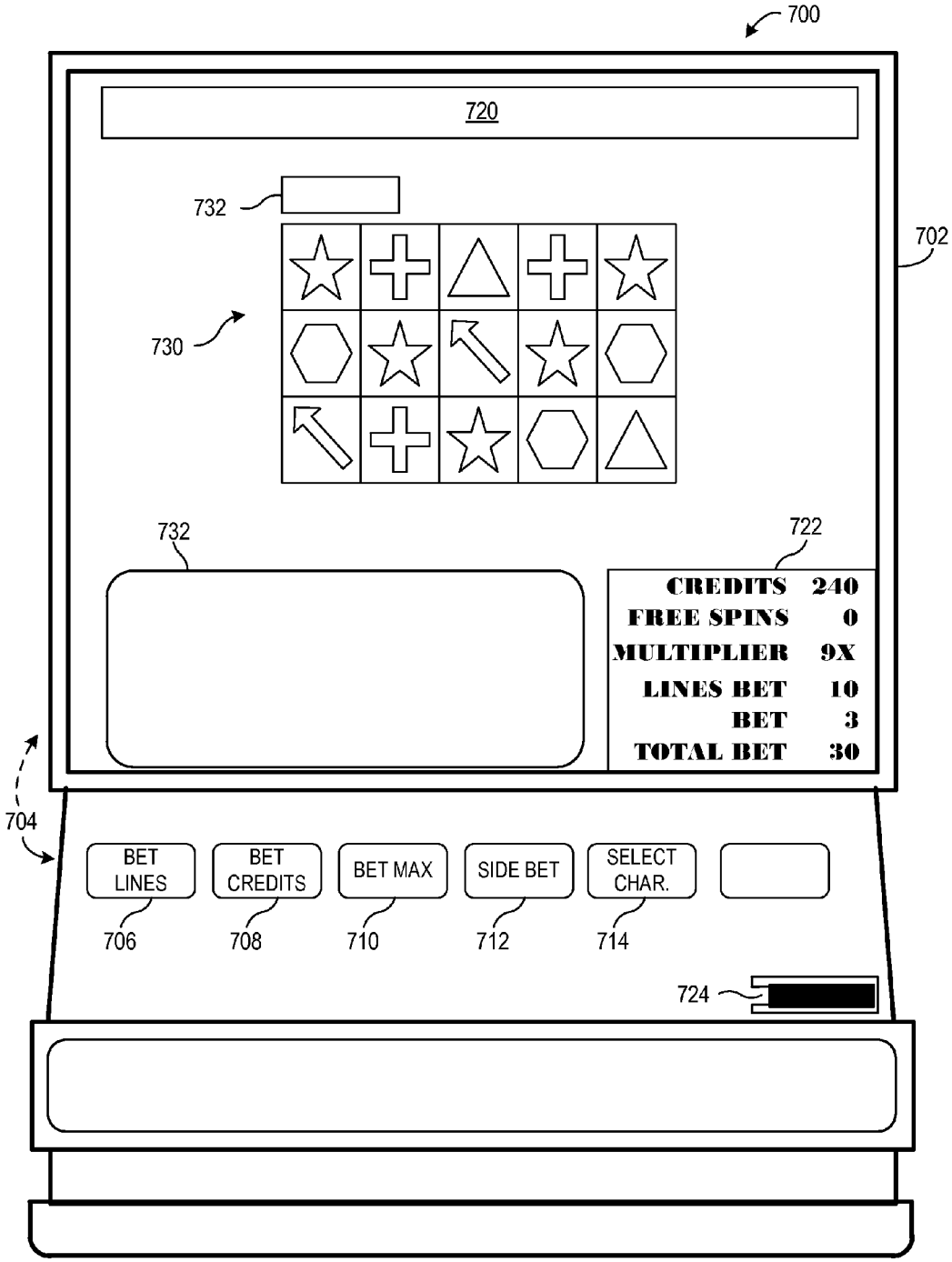
FIG. 7 is an embodiment of a casino-style gaming device in which the principles of the present invention may be applied.

The embodiments described herein may be implemented on computing systems, mechanical or electronic slot machines or other gaming kiosks, hand-held gaming devices, and the like. FIG. 7 illustrates a representative embodiment of a casino-style gaming device in which the gaming features described herein may be applied. While the description of the gaming device in FIG. 7 is provided in terms of a slot machine or similar gaming kiosk, any computer-based system is applicable.

The illustrated gaming machine 700 includes a computing system (not shown) to carry out operations according to the invention. The illustrated gaming machine 700 includes a display 702, and a user interface 704, although some or all of the user interface 704 may be provided via the display 702 in touch screen embodiments.

The user interface 704 allows the user to control and engage in play of the gaming machine 700. The particular user interface mechanisms associated with user interface 704 is dependent on the type of gaming machine. For example, the user interface 704 may include one or more buttons, switches, joysticks, levers, pull-down handles, trackballs, voice-activated input, or any other user input system or mechanism that allows the user to play the particular gaming activity. The user interface 704 may allow the user to enter coins, bills, or otherwise obtain credits through vouchers, tokens, credit cards, tickets, etc. Various mechanisms for entering such vouchers, tokens, credit cards, coins, tickets, etc. are known in the art. For example, coin/token input mechanisms, card readers, credit card readers, smart card readers, punch card readers, and other mechanisms may be used to enter wagers. It is through the user interface 704 that the user can initiate and engage in gaming activities involving embodiments described herein. For example, the user can use the user interface 704 and/or touch screen inputs to bet 706 on a number of items/paylines, bet 708 a number of credits per item/payline wagered, make gaming decisions such as place a maximum wager 710 or place secondary or side bets 712, select symbol characteristics 714 such as a user-selected characteristic indicator, etc. For example, in one embodiment, the user may be allowed to select a desired symbol indicator, such as that shown in FIG. 2A as indicator 204. In other embodiments there may be no such user selection. Some embodiments involve the user becoming eligible for the features described in connection with this description, such as placing a side bet, winning a bonus activity, etc. In other embodiments, there is no such eligibility, and the player may be eligible to receive the features described herein in the normal course of participating in the gaming event, which may or may not be based on rules indicating when the features will be presented to the player. While the illustrated embodiment of FIG. 7 depicts various "buttons" for the user interface 704, it should be recognized that a wide variety of user interface options are available for use in connection with the present invention, including pressing buttons, touching a segment of a touch-screen, entering text, entering voice commands, or other known user entry methodology.

The display device 702 may include one or more of an electronic display, a mechanical display, and fixed display information such as information such as paytable information associated with a glass/plastic panel 720 on the gaming machine 700. A display segment or panel 722 may also be provided to display information such as the accumulated credits, free spin "meter," number of lines wagered, current bet amount such as "3" credits (where credits may represent, for example, coins, tokens, dollars, etc.), the total wager for all lines/credits at play, multiplier values such as those obtained through features described herein, the number of credits paid out or "won" on a particular play, etc. A wager acceptor 724 is operative to receive wager tokens, coins, bills, credit/debit cards, coupons, smart cards, prepaid casino cards, electronic fund transfer (EFT), tickets, and the like.

In the illustrated embodiment, the gaming machine is involved in a gaming event 730 that may represent the primary or native gaming event in which the player is participating. In this embodiment, the gaming event 730 is depicted to be a slot game, where symbols are indicative of whether a player receives a payout based on, for example, symbol presentation and/or symbol combination rules. Other features, such as the indicator 732 which corresponds to indicator 204 of FIG. 2A, may also be provided via the display 702 or otherwise such as a mechanical indicator (not shown).

Figure 8:
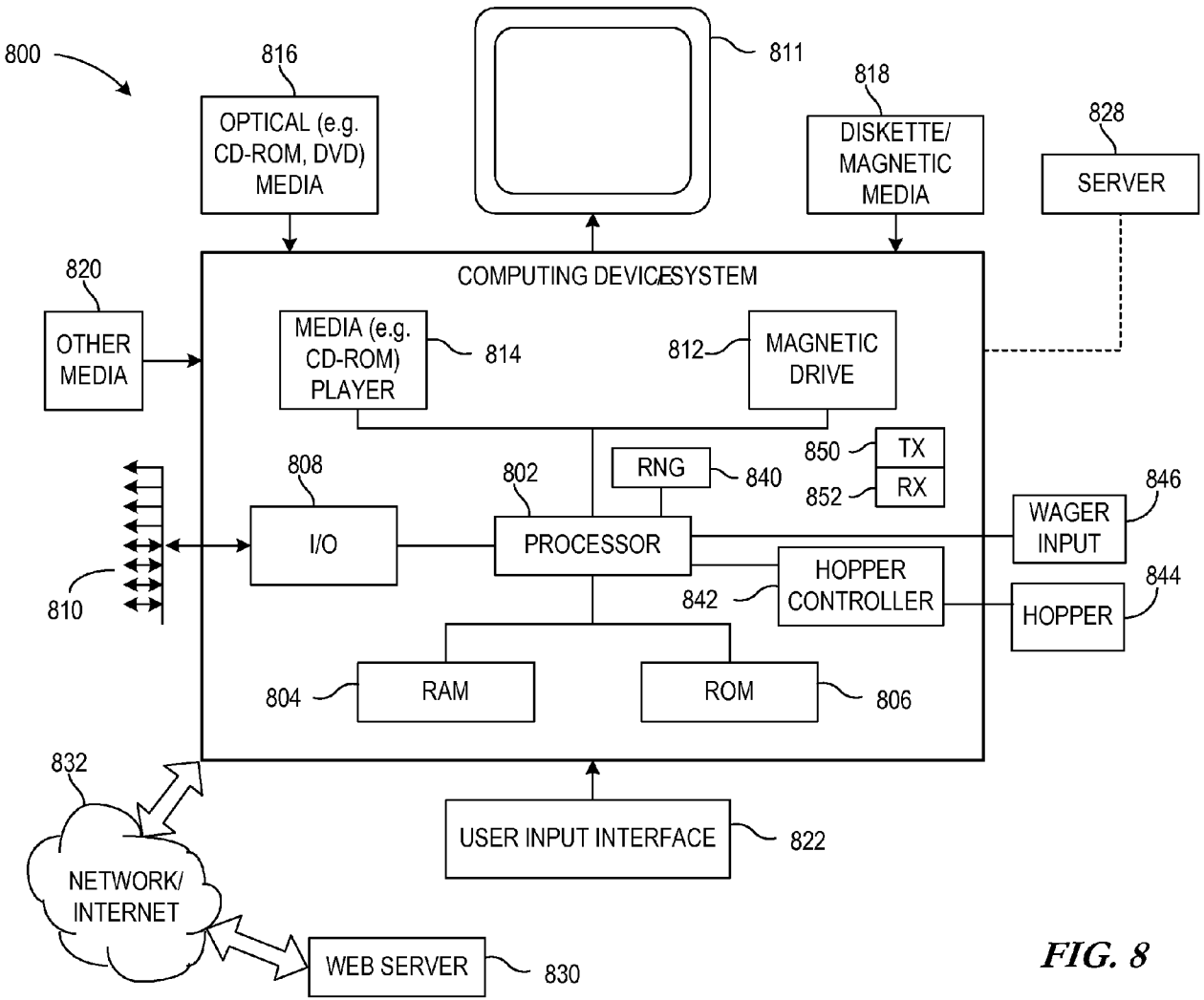
FIG. 8 is a block diagram of a representative computing system capable of carrying out operations in accordance with embodiments of the invention.

As may now be readily understood, the device 700 may be programmed to facilitate the features described herein. Features of the invention may be implemented as a casino gaming machine such as a slot machine, video gaming machine or other special purpose gaming kiosk as described in FIG. 7, or may be implemented via computing systems operating under the direction of local gaming software, and/or remotely-provided software such as provided by an application service provider (ASP). The casino gaming machine utilizes a computing system to control and manage the gaming activity. An example of a representative computing system capable of carrying out operations in accordance with the invention is illustrated in FIG. 8.

Hardware, firmware, software or a combination thereof may be used to perform the various gaming functions, display presentations and operations described herein. The functional modules used in connection with the invention may reside in a gaming machine as described, or may alternatively reside on a stand-alone or networked computing device/system. The computing structure 800 of FIG. 8 is an exemplary computing structure that can be used in connection with such electronic gaming machines, computers, or other computer-implemented devices to carry out operations of the present invention. It should be noted that the representative computing structure of FIG. 8 or analogous computing structure may be used on a local computer, kiosk, server, or any other device providing or serving the gaming functions. It should also be noted that the computing arrangement of FIG. 8 may be distributed across multiple devices (e.g., processing components at a server, and display and user interface components at a local gaming machine, etc.).

The example computing arrangement 800 suitable for performing the gaming functions in accordance with the invention typically includes a processor (e.g., CPU) 802, which may be coupled to volatile memory such as random access memory (RAM) 804 and some variation of read-only memory (ROM) 806. The depicted ROM 806 may also represent other types of storage media to store programs, such as programmable ROM (PROM), erasable PROM (EPROM), and other non-volatile memory or storage. The processor 802 may communicate with other internal and external components through input/output (I/O) circuitry 808 and bussing 810, to provide control signals, communication signals, and the like.

The chance-based gaming systems such as slot machines may be governed by random numbers and/or processors. A display device 811 is used to display the gaming activity as facilitated by one or more random number generators (RNG). RNGs may be implemented using hardware, software operable in connection with the processor 802, or some combination of hardware and software. The embodiments described herein and their equivalents are operable using any known RNG, and may be integrally programmed as part of the processor 802 operation, or alternatively may be a separate RNG controller 840.

The computing arrangement 800 may also include one or more media read and/or write devices, such as hard and floppy disk drives 812, optical drives 814 (e.g., CD-ROM, DVD, etc.), and other hardware capable of reading and/or storing information such as FLASH and other solid state storage devices, etc. In one embodiment, software for carrying out the operations in accordance with the invention may be stored and distributed on optical media 816 such as CD-ROM and DVD, magnetic media such as hard disks or diskette 818, FLASH and other solid state storage or other form of media 820 capable of storing information. These storage media may be inserted into, and read by, devices such as the optical drive 814, the magnetic drive 812, hardware receptacles for portable media, etc. The software may also be transmitted to the computing arrangement 800 via data signals, such as being downloaded electronically via a network, such as the Internet. Further, as previously described, the software for carrying out the functions associated with the present invention may alternatively be stored in internal memory/storage of the computing device 800, such as in RAM 804, ROM 806, or other storage.

The computing arrangement 800 is coupled to the display (s) 811, which represents a display on which the gaming activities are presented. The display 811 may be any type of known display or presentation screen, such as LCD displays, plasma display, cathode ray tubes (CRT), etc. Where the computing device 800 represents a stand-alone or networked computer, the display 811 may represent a standard computer terminal or display, which may also be capable of displaying multiple windows, frames, etc. Where the computing device is embedded within an electronic gaming machine (see FIG. 7), the display(s) 811 corresponds to the display screen(s) of the gaming machine/kiosk. A user input interface 822 such as a mouse, buttons, keyboard/keypad, microphone, touch pad, trackball, joystick, touch screen, voice-recognition system, etc. may be provided.

The computing arrangement 800 may be connected to other computing devices or gaming machines, such as via a network(s). The computing arrangement 800 may be connected to a network server 828 in an intranet or local network configuration. The computer may further be part of a larger network configuration as in a global area network (GAN) such as the Internet. In such a case, the computer accesses one or more web servers 830 via the network/Internet 832.

Other components directed to gaming machine implementations include manners of gaming participant payment, and gaming machine payout. For example, a gaming machine including the computing arrangement 800 may also include a hopper controller 842 to determine the amount of payout to be provided to the participant. The hopper controller may be integrally implemented with the processor 802, or alternatively as a separate hopper controller 842. A hopper 844 may also be provided in gaming machine embodiments, where the hopper serves as the mechanism holding the coins/tokens of the machine. The wager input module 846 represents any mechanism for accepting coins, tokens, coupons, bills, electronic fund transfer (EFT), tickets, credit cards, smart cards, membership cards, etc., for which a participant inputs a wager amount.

Additionally, the computing arrangement 800 may include a transmitter (TX) 850, and may include a receiver (RX) 852. These TX 850 and RX 852 components may be discrete components, or aggregated such as in the case of a transceiver. The receiver function provided by the RX 852 can be configured to receive information from any type of network, such as a local area network (LAN), wireless LAN (e.g., 802.11a/b/g, etc.), wired network (e.g., Internet), wireless network (e.g., Global System for Mobile Communications/General Packet Radio Service (GSM/GPRS), proximity networks (e.g., Bluetooth, peer-to-peer networks), and/or other wired/wireless network technologies. For example, the RX 852 may receive programming and/or operational information from a server 828 or 830 where the system is server-based. Any such server may include computing components analogous to those depicted in FIG. 8. Information such as wager information or other data used by a server can be provided to the appropriate server 828, 830 or other device or network entity via the TX 850.

It should also be recognized that the computing arrangement 800 of FIG. 8 may be implemented in a gaming apparatus, and/or in a server or other network entity that determines and provides features in accordance with the invention.

Using computing structure, a computer-readable medium may be provided that has instructions stored thereon that are executable by the computing structure to perform methods described herein. For example, in one embodiment, a computer-readable medium is provided that has instructions stored thereon which are executable by a computer system by performing steps including providing a predetermined symbol that may appear in one or more symbol locations having at least one of a plurality of different characteristics in different appearances, presenting symbols (e.g. via a reelspin), randomly selecting at least one of the plurality of different characteristics, determining whether the predetermined symbol appears in at least one symbol location as a result of the reelspin, determining which of the plurality of different characteristics was randomly selected, and in response to determining that the predetermined symbol appears in at least one symbol location and that at least one appearance of the predetermined symbol includes the randomly selected characteristic, replacing the one or more predetermined symbols having the selected at least one characteristic with a modifying symbol. Some embodiments further include analyzing resulting symbols to identify matching symbol combinations In another representative embodiment, a computer-readable medium is provided that has instructions stored thereon which are executable by a computer system by performing steps including initiating a reelspin, moving at least one modifying symbol to a new symbol location, and if a predetermined symbol appears in the new symbol location as a result of the reelspin, replacing the predetermined symbol with the modifying symbol.

From the description provided herein, those skilled in the art are readily able to combine software created as described with appropriate general purpose or special purpose computer hardware to create a computer system and/or computer subcomponents embodying the invention, and to create a computer system and/or computer subcomponents for carrying out methods of the invention. Thus, the foregoing description of the exemplary embodiments has been presented for the purposes of illustration and description. It is not intended to be exhaustive or to limit the invention to the precise form disclosed. Many modifications and variations are possible in light of the above teaching.

What is claimed is:

1. A method comprising:

initiating a reelspin;

displaying at least one modifying symbol;

moving the at least one modifying symbol to a new symbol location during the reelspin;

ending the reelspin;

determining whether a resulting symbol located in the new symbol location as a result of the reelspin is a predetermined symbol that is selected from a plurality of game symbols prior to the reelspin ending, wherein the predetermined symbol may appear having different characteristics in different eligible appearances and each eligible appearance of the predetermined symbol is modified based on the characteristics of that appearance; and replacing the resulting symbol in the new symbol location when the resulting symbol is determined to be the predetermined symbol, wherein the predetermined symbol and a random number of additional symbols are replaced with the modifying symbol in response to the predetermined symbol having a first characteristic.

2. The method of claim 1, wherein replacing the predetermined symbol includes expanding the modifying symbol to replace each symbol appearing in a group of symbol locations with the modifying symbol, the group of symbol locations including the new symbol location.

3. The method of claim 2, wherein the group of symbol locations comprises at least one of a symbol location row, a symbol location column, an established symbol location payline, a predetermined order of symbol locations, and a plurality of randomly identified symbol locations.

4. The method of claim 1, wherein the predetermined symbol is replaced with the modifying symbol and a mathematical modifying symbol in response to the predetermined symbol having a second characteristic.

5. The method of claim 1, wherein the predetermined symbol, and each symbol appearing in a group of symbol locations including the new symbol location, are replaced with the modifying symbol in response to the predetermined symbol having a third characteristic.

6. The method of claim 5, wherein the group of symbol locations comprises at least one of a symbol location row, a symbol location column, an established symbol location payline, a predetermined order of symbol locations, and a plurality of randomly identified symbol locations.

7. The method of claim 1, wherein the modifying symbol comprises a wild symbol.

8. The method of claim 1, wherein there is more than one modifying symbol and each modifying symbol moves to a different new symbol location.

9. A method comprising:

initiating a reelspin;

providing a plurality of predetermined symbols, wherein a predetermined symbol may appear having different characteristics in different eligible appearances and each eligible appearance of the predetermined symbol is modified based on the characteristics of that appearance;

moving at least one modifying symbol to a new symbol location, wherein moving the at least one modifying symbol to a new symbol location includes displaying the modifying symbol in a foreground while displaying the reelspin in a background; and when the predetermined symbol appears in the new symbol location as a result of the reelspin, replacing the predetermined symbol with the modifying symbol, wherein replacing the predetermined symbol with the modifying symbol comprises replacing the predetermined symbol with the modifying symbol when any of the plurality of the predetermined symbols appear in the new symbol location, wherein the predetermined symbol and a random number of additional symbols are replaced with the modifying symbol in response to the predetermined symbol having a first characteristic.

10. An apparatus comprising:

a user interface configured to facilitate player participation in a gaming event;

a display to present a representation of a game play area having a plurality of symbol locations; and a processor configured to initiate a reelspin, move at least one modifying symbol to a new symbol location, ending the reelspin after the at least one modifying symbol is moved to a new symbol location, and replace a predetermined symbol, that may appear having different characteristics in different eligible appearances, with the modifying symbol based on the characteristics of an eligible appearance when the predetermined symbol appears in the new symbol location at the conclusion of the reelspin, wherein the processor is further configured to replace the predetermined symbol and a random number of additional symbols with the modifying symbol when the predetermined symbol has a first characteristic.

11. The apparatus of claim 10, wherein the processor is further configured to replace the predetermined symbol with the modifying symbol and a mathematical modifying symbol when the predetermined symbol has a second characteristic.

12. The apparatus of claim 10, wherein the processor is further configured to replace the predetermined symbol and each symbol appearing in a group of symbol locations, wherein the group includes the new symbol location, with the modifying symbol when the predetermined symbol has a third characteristic.

13. The apparatus of claim 10, wherein the modifying symbol comprises a wild symbol.

14. The apparatus of claim 10, wherein there is more than one modifying symbol, each modifying symbol moves to a different new symbol location, and each predetermined symbol appearing in the corresponding new symbol locations is replaced based on the characteristics of an eligible appearance.

15. The apparatus of claim 10, wherein the processor is further configured to provide a plurality of predetermined symbols wherein replacing the predetermined symbol with the modifying symbol comprises replacing the predetermined symbol with the modifying symbol when any of the plurality of the predetermined symbols appear in the new symbol location.

16. The apparatus of claim 10, wherein the display is configured to present the symbol locations in a first plane while presenting the at least one modifying symbol in a second plane that is closer to a user.

* * * * *